US005301735A

United States Patent [19]

Chen

[11] Patent Number: 5,301,735

[45] Date of Patent: Apr. 12, 1994

[54] TEXTURED FOLDING DOOR AND FRAME ASSEMBLY

[76] Inventor: Chang-Than Chen, 181, Po-Hai Street, Kaohsiung, Taiwan

[21] Appl. No.: 962,383

[22] Filed: Oct. 19, 1992

[51] Int. Cl.[5] ..... E05D 15/26

[52] U.S. Cl. ..... 160/199; 160/236

[58] Field of Search ..... 160/199, 196.1, 201, 160/206, 235, 236

[56] References Cited

U.S. PATENT DOCUMENTS

| | | | |
|---|---|---|---|
| 2,770,298 | 11/1956 | Hiatt | 160/199 X |
| 3,234,996 | 2/1966 | King et al. | 160/199 |
| 3,359,594 | 12/1967 | Pastoor | 160/235 X |
| 3,411,561 | 11/1968 | Mock | 160/199 X |
| 3,486,549 | 12/1969 | Rosenquist | 160/199 X |
| 3,799,237 | 3/1974 | Proserpi | 160/199 |
| 4,359,080 | 11/1982 | Brydolf | 160/199 |
| 4,386,645 | 6/1983 | Dever et al. | 160/235 X |
| 4,497,357 | 2/1985 | Labelle | 160/199 |
| 4,773,958 | 9/1988 | Goodman | 160/236 X |
| 4,884,615 | 12/1989 | Hsu | 160/236 |

*Primary Examiner*—David M. Purol
*Attorney, Agent, or Firm*—John J. Posta, Jr.

[57] ABSTRACT

The improved folding door and door frame assembly includes a door frame having a horizontal top channel member adapted to receive a number of depending door slides, and a vertical side frame member below the channel member. The assembly also includes a folding door formed of an array of interconnected, parallel, vertically extending polyvinyl chloride slats arranged in side by side relation. The slats have small staple fibers substantially uniformly distributed throughout the body thereof to give the slats a translucent sandy appearance and feel. Each slat in the arry preferably is corrugated to provide a number of integral parallel segments. Each slat has an integral side folding hinge extending along the length of one side thereof and a hinge-receiving slot or groove along the length of the opposite side of the slat. The slats are interconnected through the side hinges and grooves. The slat on one side of the array is connected to the door side frame through its side hinge, while the slat on the opposite side of the array is connected to a handle-bearing side panel through the side hinge of the panel. Preferably, the panel and frame are textured to match the slats. The aforementioned slides are connected to the upper ends of the side panel and slats to hold them in the vertical position in the frame.

4 Claims, 1 Drawing Sheet

TEXTURED FOLDING DOOR AND FRAME ASSEMBLY

BACKGROUND OF THE INVENTION

1. Field of the Invention

The present invention generally relates to a polyvinyl chloride (PVC) folding door and door frame assembly and to an improved method of making the same.

2. Prior Art

Various types of folding doors are currently available. Some are of vertical wood slats hinged together and hung by slides from a door frame. Others are fabricated of smooth surfaced opaque PVC panels, which provide, when closed across a doorway, a sterile, cold, flat, blank appearance which is generally unattractive.

Accordingly, it would be desirable to be able to provide an improved PVC folding door which transmits some light, even when closed, is inexpensive and attractive in appearance and which does not look smooth, plastic, hard and cold. Preferably, the door should be easy to assemble and have a novel textured natural appearance which is permanent and which more closely blends in with other decorative features.

SUMMARY OF THE INVENTION

The improved folding door and frame assembly of the present invention and the method of providing it satisfy all the foregoing needs. The assembly includes a door frame having a top horizontal channel member which slidably receives a plurality of depending slide fasteners, and a vertical side frame. The assembly also includes a folding door of novel construction and appearance and a plurality of the fasteners connected to the top of the door and holding the door in the frame for sliding between a folded open position and an unfolded closed position.

The door is formed of an interconnected array of vertical, parallel slats of translucent PVC having a plurality of staple fibers of less than about 2 mm. average length and comprising cotton, flax, wool or mixtures thereof distributed substantially uniformly throughout the body thereof to impart to the slats a mottled novel appearance and a sandy texture and feel which blends well with modern decorative arrangements.

Each slat is fabricated from a mixture of PVC, PVC plasticizer, titanium dioxide, tribasic lead sulfate, stearic acid and the staple fibers by first pelletizing the mixture, then heating it to about 162–171 degrees C. and extruding it into the desired slats, then cooling and cutting the slats to length.

Each slat is of novel configuration. Each slat has a foldable hinge integral with one side thereof along the length thereof, while the opposite side of each slat bears a hinge-receiving slot or groove along the length thereof. The slats are interconnected through the hinges and grooves to form the desired array. One side of the array is connected to the side frame through a slat hinge while the opposite side of the array is connected to a door side panel bearing a handle and side hinge received in a slat groove. The fasteners are connected to the tops of the panels and side panel to hang the door in the frame from the top channel member.

Preferably, the frame and door panel are textured to match the slats and may be of PVC. Each slat has a plurality of integral parallel vertical segments, so that each slat is preferably corrugated in appearance. Various other features of the present assembly and method are set forth in the following detailed description and accompanying drawings.

DRAWINGS

The single FIGURE is a schematic front perspective view of a preferred embodiment of the improved assembly of the invention.

DETAILED DESCRIPTION

FIG. 1

Figure 1:
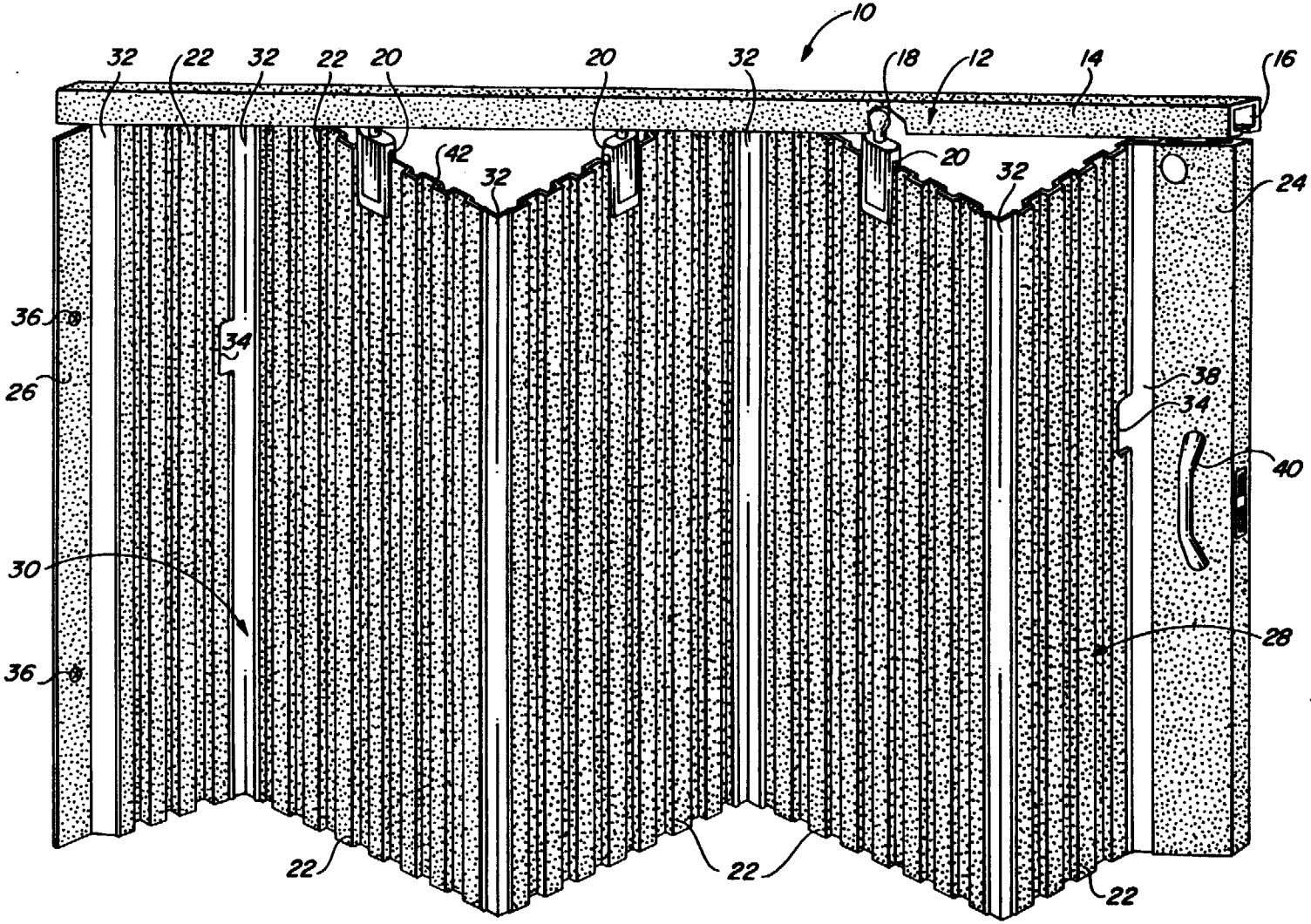

Now referring more particularly to the single FIGURE of the drawings, a preferred embodiment of the improved folding door and frame assembly of the present invention is schematically depicted therein. Thus, assembly 10 is shown which comprises a door frame 12 which includes a top horizontal channel member 14 adapted to be secured to the underside of the top of a doorway frame (not shown) and which is generally inverted U-shaped in transverse cross-section. Member 14 has a channel 16 therein open at the bottom thereof (not shown) which is adapted to slidably receive the heads 18 of slide fasteners 20 which depend therebelow and which are connected to the upper ends of slats 22 and door side panel 24, hereinafter more particularly described, holding them in operating position below member 14. Door frame 12 also includes vertical side frame 26 connected thereto and extending therebelow.

Assembly 10 also includes door 28 which comprises slats 22 arranged in an array 30 connected to frame 26 and to side panel 24. In accordance with the method of the present invention, each slat 22 is formed by the present method, as exemplified by the following specific example:

EXAMPLE

PVC, conventional PVC plasticizer, tribasic lead sulfate, stearic acid and staple fibers, of less than about 2 mm. in average length, are mixed together to form the following mixture:

PVC—about 100 parts by weight
titanium dioxide—about 4 parts by weight
plasticizer—about 2 parts by weight
tribasic lead sulfate—about 1.4 parts by weight
stearic acid—about 0.2 parts by weight
staple natural or synthetic fibers of cotton, nylon, polyester, wool and/or flax—about 1–2 parts by weight (fiber average length less than 2 mm.)

The resulting mixture is pelletized and the resulting pellets are heated to about 162–171 degrees C., then passed through a specially configured extrusion die to form slats 22, which are then cooled and cut transversely into the desired lengths.

It will be understood that different proportions of the ingredients than those specified above can be used in the mixture, so long as the desired slats 22 are obtained, exhibiting desired translucency and sandy appearance, texture and feel. The PVC plasticizer may be, for example, any conventional PVC plasticizer such as nonvolatile ester, low molecular weight resin or certain types of rubber. Slats 22 may be of any suitable thickness, providing they are self-supporting and translucent, e.g., 1/321/16 inch thick.

As can be seen from the single FIGURE, each slat 22 has an integral folding hinge 32 extending laterally outwardly from one side thereof along the length thereof, and a corresponding slot or groove 34 along the length thereof on the opposite side thereof, within which the hinge 32 of the next adjacent slat 22 is received to hold slats in the side-by-side door-forming array 30 shown in the single FIGURE.

A slat 22 on one side of array 30 is secured, as by screws 36, to vertical side frame 26 while a slat 22 on the opposite side of array 30 is secured to door side panel 24 by receiving within its groove 34 a laterally extending side hinge or connector 38. Thus, array 30 is securely connected to frame 12 by vertical side frame 26 and by slide fasteners 20 connected to slats 22 and door side panel 24. Panel 24 bears a handle 40 which allows door 28 to be folded to the fully open position or closed partially or totally.

As can be seen from the above, array 30 is easy to assemble, as is frame 12, and array 30 and panel 24 are easy to assemble with frame 12 to form the improved assembly 10. Preferably, frame 12 and panel 24 are coated with material which duplicates the texture and appearance of array 30, so that the entire assembly 10 has a substantially uniform appearance, except for the translucency and mottled appearance of array 30.

It will be also noted that each slat 22 preferably comprises a plurality of integral, parallel, vertically oriented segments 42 which provide slats 22 with a corrugated appearance. One form of that appearance is shown in the single FIGURE where successive segments form U-shaped, three sided offset boxes with open sides facing in opposite directions. It will be understood that various other configurations for segments 42 can be used, if desired.

Various modifications, changes, alterations and additions can be made in the improved folding door assembly of the present invention, its components and their parameters, and in the improved method of the present invention and in its steps and parameters. All such modifications, changes, alterations and additions as are within the scope of the appended claims form part of the present invention.

What is claimed is:

1. An improved textured folding door and door frame assembly, said assembly comprising, in combination:

a) a door frame, including, in combination,
   i. a horizontal channel member, generally U-shaped in transverse cross-section, and having a slide channel therein, and,
   ii. a vertical side frame;

b) a folding door comprising,
   i. a vertical side panel bearing a handle and including a side hinge running the length of a side thereof,
   ii. an array of interconnected, parallel, translucent polyvinyl chloride slats having a plurality of staple fibers substantially uniformly distributed therethrough so that said slats have a sandy texture and appearance, each said slat in said array comprising a plurality of integral, parallel, vertical interconnected segments, each said slat including at least one integral foldable side hinge connected to a side thereof along the length thereof and received within a groove extending the length of the side of a next adjacent one of said slats in said array, one of said slats, namely the slat in said array facing one side of said array having its side hinge connected to said vertical side frame, and said slat on the opposite side of said array receiving said foldable side panel hinge; and, c) guide means connected to the tops of said side panel and said slats and slidably received within said channel member for movement of said door between a folded and open position along the length of said channel member.

2. The improved assembly of claim 1 wherein said slats are corrugated and of a mottled appearance.

3. The improved assembly of claim 1 wherein said door frame and side panel match said slats in texture.

4. The improved assembly of claim 1 wherein said staple fibers are selected from the group consisting of natural or synthetic fibers of nylon, polyester, cotton, flax, wool and mixtures thereof and the average length of each said fiber is less than about 2 mm.

* * * * *